US011530549B1

(12) United States Patent
Rice et al.

(10) Patent No.: US 11,530,549 B1
(45) Date of Patent: Dec. 20, 2022

(54) MODULAR, RECONFIGURABLE ENVIRONMENT ISOLATION STRUCTURES AND RELATED METHODS

(71) Applicant: Cornerstone Research Group, Inc., Miamisburg, OH (US)

(72) Inventors: Jason P. Rice, Dayton, OH (US); Mary T. Parrish, Kettering, OH (US); Ben Dietsch, Dayton, OH (US)

(73) Assignee: CORNERSTONE RESEARCH GROUP, INC., Miamisburg, OH (US)

( * ) Notice: Subject to any disclaimer, the term of this patent is extended or adjusted under 35 U.S.C. 154(b) by 0 days.

(21) Appl. No.: 17/178,545

(22) Filed: Feb. 18, 2021

Related U.S. Application Data

(60) Provisional application No. 62/978,608, filed on Feb. 19, 2020.

(51) Int. Cl.

| | |
|---|---|
| ***E04H 15/44*** | (2006.01) |
| ***E04H 15/18*** | (2006.01) |
| ***E04H 15/54*** | (2006.01) |
| ***E04H 15/64*** | (2006.01) |
| ***E04H 15/60*** | (2006.01) |

(52) U.S. Cl.
CPC ..... *E04H 15/44* (2013.01); *E04H 15/18* (2013.01); *E04H 15/54* (2013.01); *E04H 15/60* (2013.01); *E04H 15/64* (2013.01)

(58) Field of Classification Search
CPC ..... E04H 15/44; E04H 15/18; E04H 15/60
USPC ..... 280/250.1, 210
See application file for complete search history.

(56) References Cited

U.S. PATENT DOCUMENTS

| | | | | |
|---|---|---|---|---|
| 3,632,147 | A * | 1/1972 | Finger | A47F 5/14 403/171 |
| 4,026,286 | A | 5/1977 | Trexler | |
| 4,129,975 | A * | 12/1978 | Gabriel | A63H 33/101 D8/382 |
| 4,667,451 | A * | 5/1987 | Onoda | E04B 1/34331 D25/13 |
| 4,745,725 | A * | 5/1988 | Onoda | B64G 9/00 52/646 |
| 4,761,929 | A * | 8/1988 | Zeigler | E04H 15/34 52/81.3 |
| 5,125,206 | A * | 6/1992 | Motohashi | E04B 1/19 52/646 |
| 6,722,086 | B2 * | 4/2004 | Boots | E04B 1/3211 52/81.3 |

(Continued)

FOREIGN PATENT DOCUMENTS

| | | | |
|---|---|---|---|
| CA | 2172929 | A1 | 9/1997 |
| TW | 201139764 | A1 | 11/2011 |

*Primary Examiner* — Noah Chandler Hawk
(74) *Attorney, Agent, or Firm* — TraskBritt

(57) ABSTRACT

Environment isolation structures may include a frame and flexible panels at least partially covering, and attached to, the frame. The frame may include multidirectional node connectors including multiple locations for attachment. At least some of the locations for attachment may be located on different sides of the multidirectional node connectors. Poles configured to telescope to selectively fixable lengths may include connectors affixed to longitudinal ends of the poles. Each connector may be configured to selectively attach to a respective location for attachment on a given side of a respective multidirectional node connector to form the frame.

22 Claims, 8 Drawing Sheets

(56) References Cited

U.S. PATENT DOCUMENTS

| | | | | |
|---|---|---|---|---|
| 7,063,481 | B2 * | 6/2006 | Trull | E04H 15/44 403/396 |
| 10,167,644 | B1 | 1/2019 | Aliev | |
| 10,443,233 | B2 * | 10/2019 | von Gonten | E04H 9/0215 |
| 2012/0216844 | A1 * | 8/2012 | DiSabantonio, III | E04H 6/02 135/121 |
| 2016/0208513 | A1 | 7/2016 | Ways | |

* cited by examiner

MODULAR, RECONFIGURABLE ENVIRONMENT ISOLATION STRUCTURES AND RELATED METHODS

CROSS-REFERENCE TO RELATED APPLICATION

This application claims the benefit under 35 U.S.C. § 119(e) of U.S. Provisional Patent Application Ser. No. 62/978,608, filed Feb. 19, 2020, for "MODULAR, RECONFIGURABLE ENVIRONMENT ISOLATION STRUCTURES AND RELATED METHODS," the disclosure of which is incorporated herein in its entirety by this reference.

FIELD

This disclosure relates generally to modular, reconfigurable environment isolation structures for temporarily isolating a site and providing at least some control over the site's atmosphere, such as, for example, a repair site, a temporary medical facility, a clean room, or a temporary laboratory or testing site. More specifically, disclosed embodiments relate to lightweight, easy to assemble and reconfigure, modular, environment isolation structures of customizable size and shape, which may enable easier, lower cost, on-site isolation of an enclosed, three-dimensional space for repair and maintenance.

BACKGROUND

The use of composite materials on aircraft structures has introduced significant complexity in the repair and maintenance of modern aircraft, particularly military aircraft. One of the key challenges is the ability of field level maintainers to perform complicated repairs in restrictive and severe environments, with limited access to controlled environments such as climate-controlled hangars. In many cases, high winds and loose debris (e.g., dirt, sand, leaves) contaminate the repair surface during the critical steps leading up to, and including, material application and cure in field repairs. Since repair of aircraft coatings must be performed in specified atmospheric conditions (temperature, humidity, particulate), at least in some instances, these challenges necessitate the use of Environment Control Units (ECU), which recirculate and condition air within an enclosure in field repair. ECUs are typically connected to custom enclosures and ducting fabricated by the maintainer. Sourcing the components and fabricating custom enclosures for use on-aircraft leads to increased downtime and maintenance costs.

BRIEF SUMMARY

In some embodiments, environment isolation structures may include a frame. The frame may include multidirectional node connectors having multiple attachment locations. At least some of the attachment locations may be located on different sides of the multidirectional node connectors. Poles of the frame may be configured to telescope to selectively fixable lengths. Connectors affixed to longitudinal ends of the poles may be configured to selectively attach to a respective attachment location on a given side of a respective multidirectional node connector. Flexible panels may be configured to at least partially cover, and be attached to, the frame.

In other embodiments, methods of assembling environment isolation structures may involve attaching connectors at longitudinal ends of poles to multidirectional node connectors to form a base polygonal shape. Additional connectors at longitudinal ends of additional poles may be attached to the multidirectional node connectors of the base polygonal shape to form lateral side shapes. Remaining connectors at the longitudinal ends of the additional poles may be connected to additional multidirectional node connectors to form a frame having a polyhedron shape. The polyhedron shape may be adjusted by selectively adjusting lengths of at least some of the poles and subsequently fixing the lengths of the relevant poles. In some embodiments, adjustment of the polyhedron shape of the frame may also involve changing an angle at which one or more of the poles is oriented with respect to a fixed reference plane (e.g., a vertical plane, a horizontal plane, a plane in which one of the faces of the polyhedron shape that has not moved or been adjusted lies). Flexible panels may be draped over the frame and the panels may be attached to the frame to form the environment isolation structure.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings. In the drawings:

DETAILED DESCRIPTION

Figure 1:
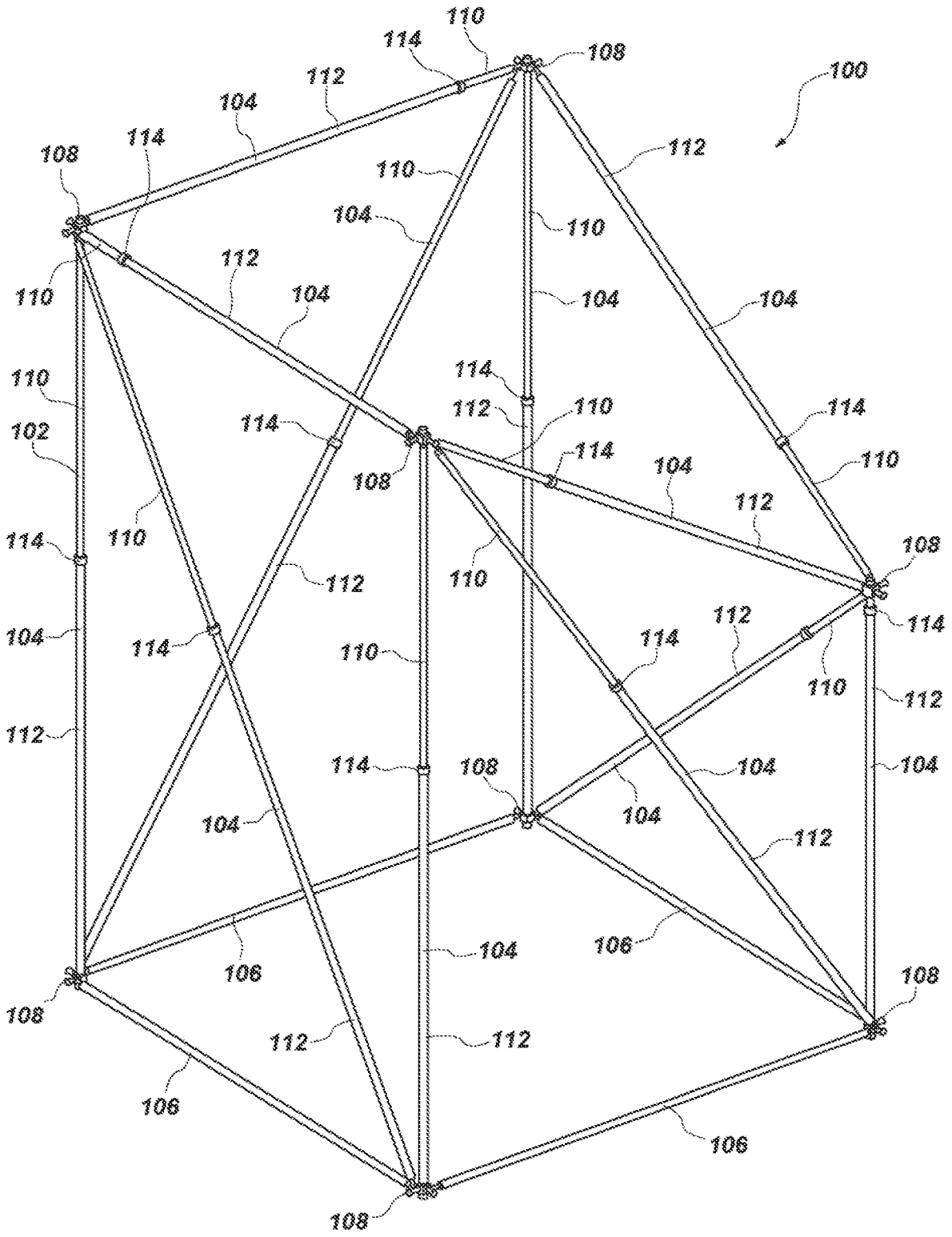
FIG. 1 is a perspective side view of an environment isolation structure in accordance with this disclosure.

The illustrations presented in this application are not meant to be actual views of any particular environment isolation structure, intermediate product in a method of assembling an environment isolation structure, or component thereof, but are merely idealized representations employed to describe illustrative embodiments. Thus, the drawings are not necessarily to scale.

Disclosed embodiments relate generally to lightweight, easy to assemble and reconfigure, modular, environment isolation structures of customizable size and shape, which may enable easier, lower cost, on-site isolation of an enclosed, three-dimensional space for situations benefitting from physical separation and at least partial control over an atmosphere within the space, such as, for example, repair and maintenance, medical testing and treatment, small-batch, on-site manufacturing, on-site use, mixing, and/or application of chemicals and other sensitive materials. More specifically, disclosed are embodiments of environment isolation structures including poles selectively attachable at their ends to multidirectional node connectors to form a frame having a polyhedron shape, where the poles are adjustable in length to customize the size and shape of the frame, and including flexible panels attachable to the frame to at least substantially enclose the environment isolation structure and grant selective access to the enclosed environment.

In some embodiments, the multidirectional node connectors and the connectors of the poles may be configured to constrain movement of the poles relative to the multidirectional node connectors, and of the multidirectional node connectors relative to the poles, in at least some directions. For example, the connectors of at least some of the poles may be configured to constrain movement of those poles relative to a connected multidirectional node connector about all but one axis of rotation and all but one direction of linear translation, and the connectors of at least some others of the poles may be configured to constrain movement relative to another connected multidirectional node connector about all but two or three axes of rotation and all but one direction of linear translation. As another example, the multidirectional node connectors, poles, and connectors of the poles may be configured to constrain movement of at least one of the multidirectional node connectors to be linear with respect to at least another of the multidirectional node connectors. As yet another example, the multidirectional node connector, poles, and connectors are configured to constrain movement of a subset of the multidirectional node connectors to be linear with respect to a remainder of the multidirectional node connectors. By selecting and deliberately designing the degrees of freedom for the poles and the multidirectional node connectors, environment isolation structures in accordance with this disclosure may enable fast, easy set-up and placement of a given environment isolation structure proximate to a repair area while enabling the environment isolation structure to have sufficient strength to define the isolation space, at least to be self-supporting around that space.

The inventors herein have recognized that a desirable system for environmental containment or repair area isolation should enable the user (e.g., maintainer personnel effecting a repair) to establish a barrier that prevents blowing debris from contaminating the repair area without restricting the ability to effect the repair. In addition, embodiments of repair and isolation enclosures in accordance with this disclosure may enable the user, such as the maintainer to set up and take down the system quickly and easily. The disclosed enclosure systems herein may be fixable and orientable relative to the desired part or region of the aircraft, which may be on upper, lower, side, sloping, and/or curved surfaces of the aircraft, during the repair operations. Furthermore, the systems may be compact when stored, and may be lightweight to enhance portability. Finally, enclosure systems in accordance with this disclosure may enable the maintainer to easily access the repair site while the system is deployed, and to pass repair materials through the boundary between the exterior and interior of the enclosure while executing the repair. Such a system may take the form of a reusable, reconfigurable enclosure system or kit, which may improve efficiency of aircraft repairs, particularly and without limitation, repairs to composite aircraft structures and components.

In some embodiments, environment isolation structures in accordance with this disclosure may include a frame including multidirectional node connectors, poles, and connectors at longitudinal ends of the poles for selectively attaching the poles to the multidirectional node connectors. For example, the multidirectional node connectors may include multiple attachment locations, at least some of the attachment locations located on different sides of the multidirectional node connectors. More specifically, each multidirectional node connector may include, for example, an at least substantially polyhedron shape and each attachment location may be located on a different face of the at least substantially polyhedron shape. As a specific, nonlimiting example, each multidirectional node connector may include an at least substantially cubic shape including one of the attachment locations on each side of the at least substantially cubic shape. In some embodiments, some sides of a given multidirectional node connector may include multiple attachment locations on the same side.

Each of the multidirectional node connectors may include, for example, at least one threaded female receptacle forming at least one of the attachment locations and at least one snap female receptacle forming at least another of the attachment locations. The at least one snap female receptacle may include a hole including a dual-diameter shape forming a ledge sized, shaped, and positioned to receive a selectively latchable pin therein. For examples, such snap female receptacle may include a hole having an internal groove shaped to receive a detent pin therein. More specifically, each of the multidirectional node connectors may include, for example, threaded female receptacle on two opposite sides of the respective multidirectional node connector and snap female receptacles on the remaining sides of the respective multidirectional node connector.

The attachment locations may enable the environment isolation structure to be attached to another, adjacent environment isolation structure as a module, which may facilitate expansion of the environmental isolation structure utilizing multiple modular frames to expand the size and/or shape of the isolated environment.

At least some of the poles may be configured to telescope to selectively fixable lengths, enabling a size and shape of the frame formed when the poles are assembled with the multidirectional node connectors to be adjusted. Others of the poles may be fixed in length pole such that at least one face of the frame may have an at least substantially fixed size and shape.

Connectors may be affixed to longitudinal ends of the poles or be made as an integral, unitary part located at the ends of the poles. Each connector may be configured to selectively attach to a respective attachment location on a given side of a respective multidirectional node connector. For example, each of the connectors may include an eyelet joint or heim joint configured to selectively attach to a respective attachment location on a given side of a respective multidirectional node connector utilizing a selectively latchable pin, which may facilitate fast, easy, on-site assembly of the frame. The selectively latchable pins may include, for example, spring-loaded, quick-release detent pins. In some embodiments, each of the selectively latchable pins may include a tether configured to form a secondary, backup attachment between each of the selectively latchable pins and a remainder of the environment isolation structure (e.g., the frame), which may reduce the likelihood that the pins may fall away from the environment isolation structure and become contaminating debris within the isolated environment.

In some embodiments, at least one of the attachment locations and at least two of the connectors may be configured to attach to one another, such that the longitudinal ends of two poles extend toward, and are selectively attachable to, the at least one of the attachment locations. In other words, the longitudinal ends of multiple poles may terminate at, and be attached to, the same side of a multidirectional node connector, which may better reinforce the frame.

Flexible panels may at least partially cover, and be attached to, the frame. The flexible panels may be translucent or transparent, enabling those outside the isolated environment to better monitor environmental conditions and the status of any personnel within the isolated environment. Each of the flexible panels may include at least one hook-and-loop connector proximate to at least one distal end of each of the flexible panels, which may enable the panels to be temporarily attached to a structure surrounding the isolated environment and/or to be temporarily attached to corresponding panels of an adjacent module of the environmental isolation structure to expand the size of the isolated environment.

At least one bumper may be configured to selectively attach to a respective attachment location on a given side of a respective multidirectional node connector, which may reduce the likelihood that the assembled frame may damage the structure surrounding the environment to be isolated during deployment of the frame.

In some embodiments, environment isolation structures in accordance with this disclosure may weigh about 35 lbs or less and may be configured to be assembled by about 3 or fewer people in about 5 minutes or less.

Methods of assembling environment isolation structures in accordance with this disclosure may involve, for example, attaching connectors at longitudinal ends of poles to multidirectional node connectors to form a base polygonal shape. Additional connectors at longitudinal ends of additional poles may be attached to the multidirectional node connectors of the base polygonal shape to form lateral side shapes. Remaining connectors at the longitudinal ends of the additional poles may be attached to additional multidirectional node connectors to form a frame comprising a polyhedron shape. The polyhedron shape may be adjusted by selectively adjusting lengths of at least some of the poles and subsequently fixing the lengths of the at least some of the poles. Flexible panels may be draped over the frame and the panels may be attached to the frame to form the environment isolation structure. In some embodiments, other connectors at longitudinal ends of other poles may be attached to a respective multidirectional node connector and a respective additional multidirectional node connector of each lateral side shape to form a crossbar bisecting each respective lateral side shape in order to enhance the structural rigidity of the frame.

As used herein, the terms "substantially" and "about" in reference to a given parameter, property, or condition means and includes to a degree that one of ordinary skill in the art would understand that the given parameter, property, or condition is met with a degree of variance, such as within acceptable manufacturing tolerances. For example, a parameter that is substantially or about a specified value may be at least about 90% the specified value, at least about 95% the specified value, at least about 99% the specified value, or even at least about 99.9% the specified value.

As used herein, terms of relative positioning, such as "up," "down," "left," "right," "upper," "lower," "vertical," and "horizontal," refer to the orientation specifically shown in the figure being described. Environment isolation structures may be deployed in configurations, and orientations, other than those shown in the drawings, as described in illustrative variations in this disclosure. Such reconfiguration and reorientation will necessarily require recontextualizing the terms of relative positioning based on changes made relative to the configurations and orientations shown and described herein.

The term "face," when used in connection with a frame for an environment isolation structure herein, refers to an at least substantially planar shape bordered by poles of the frame. For example, a face may have a polygon shape, and may define a portion of a larger polyhedron shape of the frame as a whole.

FIG. 1 is a perspective side view of an environment isolation structure 100 in accordance with this disclosure. The environment isolation structure 100 may include a frame 102 and flexible panels 504 (see FIG. 5) configured to at least partially cover, and be attached to, the frame 102. The environment isolation structure 100, including the frame 102 and the flexible panels 504 (see FIG. 5), may be configured to be modular, capable of assembly and disassembly, adjustable, and lightweight. Such properties, and other properties of the environment isolation structure 100, may enable a user to more quickly and easily deploy the environment isolation structure 100 and to alter a shape, configuration, or shape and configuration of the environment isolation structure 100 to better fit a given area to be isolated.

The frame 102 of the environment isolation structure 100 may include multidirectional node connectors 108 forming nodes (e.g., corners, points of intersection) to which poles 104 of the frame 102 may be connected. More specifically, ends of the poles 104 may at least substantially converge proximate to, and be temporarily securable to, respective ones of the multidirectional node connectors 108 to form the frame 102. As a specific, nonlimiting example, some of the ends of the poles 104 may be affixed to, and constrained by, the multidirectional node connectors 108, and others of the ends of the poles 104 may be secured to, and have at least some freedom of movement relative to, the multidirectional node connectors 108. Selection of which components may be permitted freedom of movement, when movement may be enabled and disabled, and what kinds of freedom of movement can be enabled in accordance with this disclosure may produce an environment isolation structure 100 having significant advantages over existing environment isolation structures known to the inventors.

At least some of the poles 104 may be configured to adjust to selectively fixable lengths. For example, a majority of the poles 104 may include a first pole portion 110 having a first diameter, a second pole portion 112 having a second, larger diameter, and the first pole portion 110 may be located at least partially inside the second pole portion 112. Those poles 104 having adjustable lengths may further include a releasable clamp 114 (e.g., a tube-to-tube collet clamp, a telescoping collet clamp, a quick-release tube clamp, a twist-lock friction-fit clamp, a toggle clamp), which may have an annular shape to enable the first pole portion 110 to slide into and out of the clamp 114 and which may enable a user to selectively fix or adjust the length of the poles 104. Adjustment of the length of a given pole 104 may be accomplished by releasing the clamp 114 of that pole 104, sliding the first pole portion 110 farther into our out from the second pole portion 112, and retightening the clamp 114 to at least temporarily fix the length of the respective pole 104.

In some embodiments, at least one of the poles of the frame 102 may be a fixed-length pole 106, which may not be adjustable in length. For example, the assembled frame 102 may generally take the form of a polyhedron shape, and borders of at least one face of the polyhedron shape of the frame 102 (e.g., borders of what would be a generally planar surface of the polyhedron shape) may be formed by fixed-length poles 106. Having one or more faces of the polyhedron shape of the frame 102 bordered, or at least partially bordered, by fixed-length poles 106 may simplify assembly and deployment, increase structural strength of the frame 102, and increase stability in contrast to adjustable faces. When assembling the frame 102 a face formed by the fixed-length poles 106 may typically be oriented to face downward (e.g., to rest on the floor), though a face formed by the fixed-length poles 106 may also be oriented in other directions (e.g., toward a horizontal, lateral side of the frame 102, upward).

Some of the poles 104 having adjustable lengths and at least some of the fixed-length poles 106 may be positioned at exterior edges of the polyhedron shape of the frame 102. For example, those poles 104 and fixed-length poles 106 positioned at the exterior edges (i.e., vertically-extending edges) of the frame 102 may extend from one multidirectional node connector 108 at one corner of a polygon shape of one face of the frame 102 to an adjacent multidirectional node connector 108 at an adjacent corner of the polygon shape of the same face of the frame 102. Others of the poles 104 having adjustable lengths, and optionally others of the fixed-length poles 106, may be positioned within (i.e., across) the planes of the polyhedron shape of the frame 102. For example, another pole 104 having an adjustable length, or another fixed-length pole 106, may extend from one multidirectional node connector 108 at one corner of a face of the frame 102 to another multidirectional node connector 108 at a non-adjacent corner of the same face of the frame 102 or at a corner of another face of the frame 102. More specifically, another pole 104 having an adjustable length may extend from one multidirectional node connector 108 at one corner of the polygon shape to another multidirectional node connector 108 at an opposite corner of the polygon shape. As a specific, nonlimiting example, the frame 102 may include six faces, and the diagonally extending poles 104 having adjustable lengths may extend across four of those faces (e.g., the horizontal-, lateral-facing faces), with the remaining faces (e.g., the upward- and downward-oriented faces) lacking any such diagonally extending poles 104.

The poles 104 and the fixed-length poles 106 may include tubes of a material having high strength and rigidity for its density. For example, the poles 104 and the fixed-length poles 106 may include tubes of carbon fiber in a polymer matrix material, aluminum, or other materials.

Figure 2:
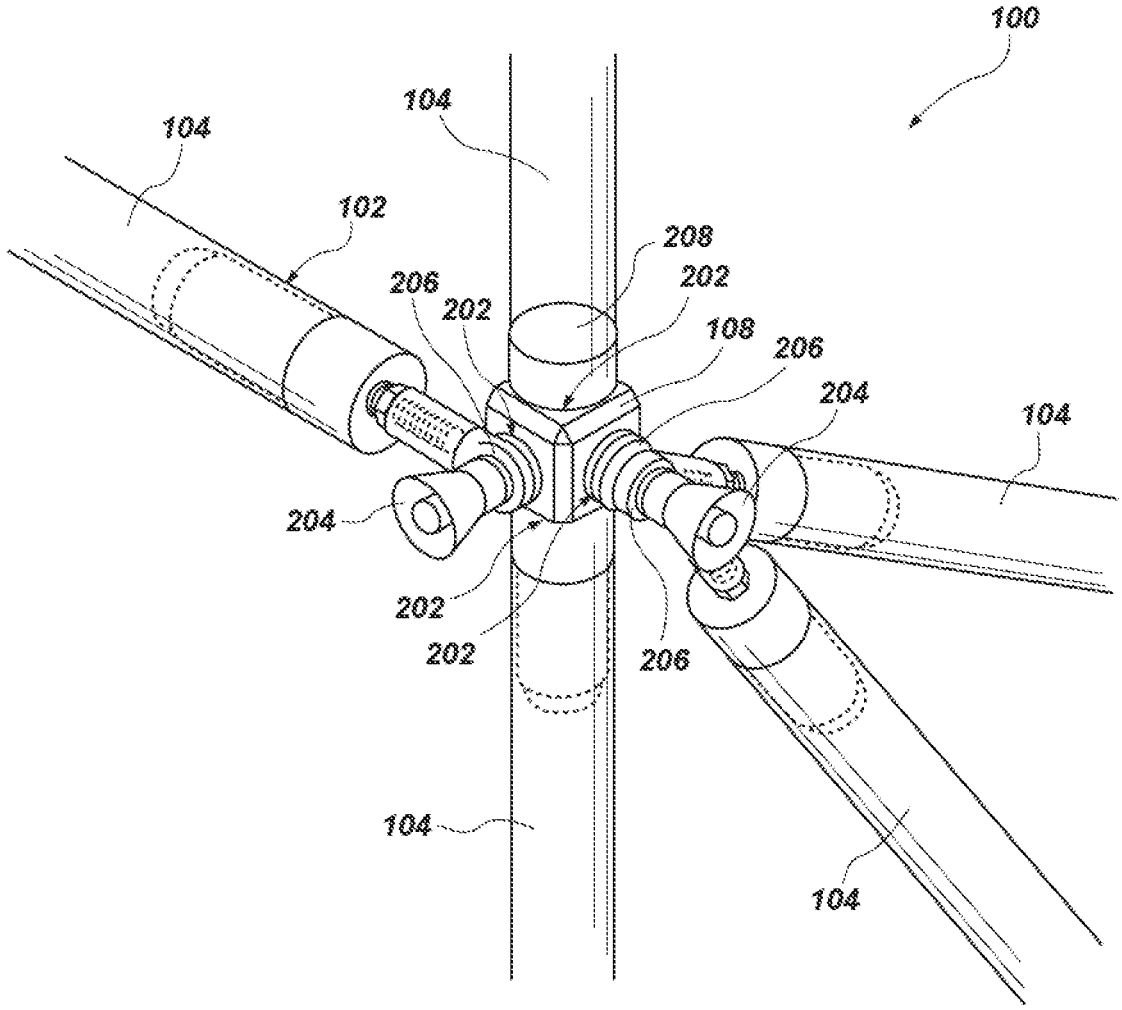
FIG. 2 is an enlarged perspective side view of a multidirectional node of the environment isolation structure of FIG. 1.
Figure 3:
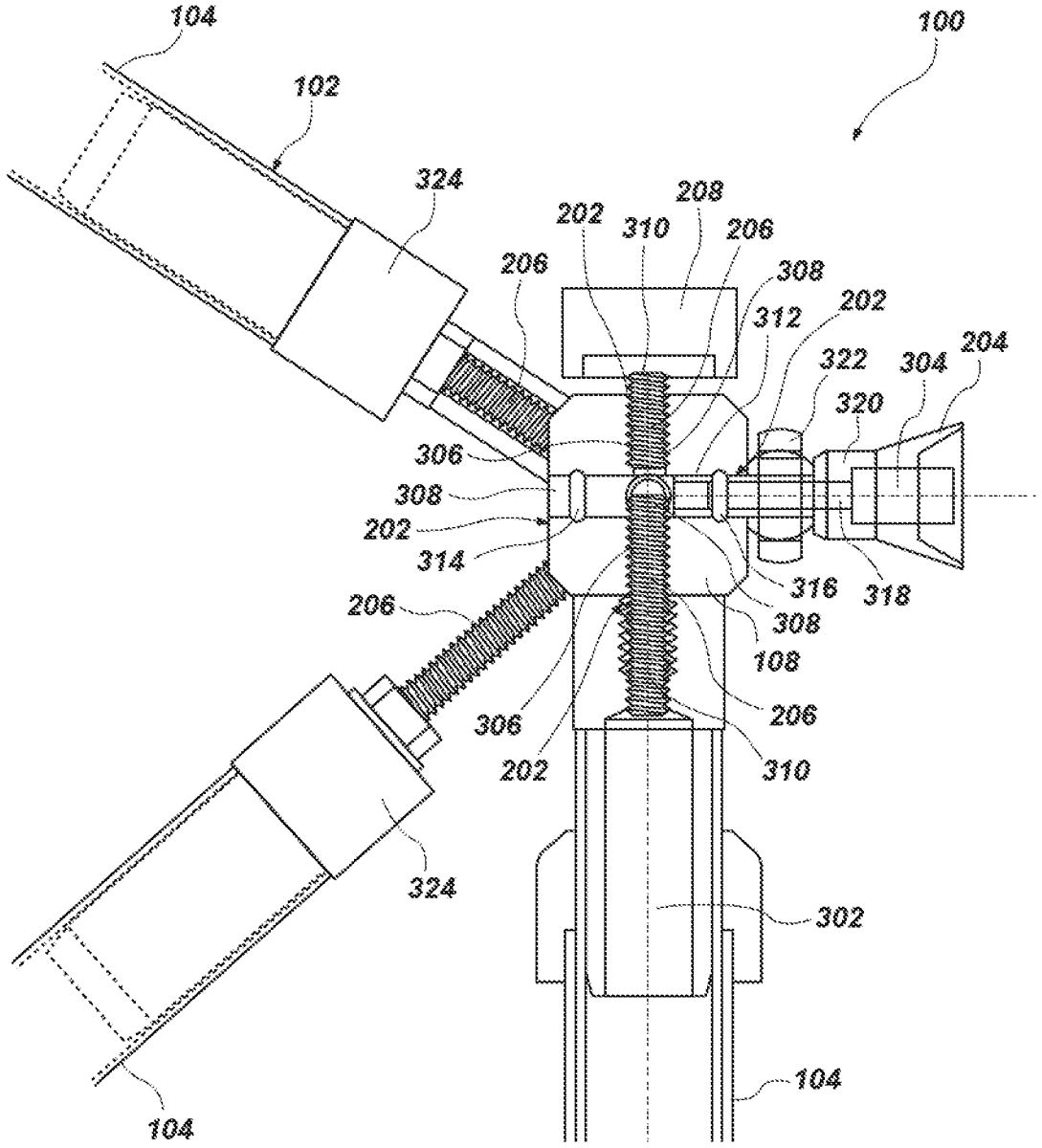
FIG. 3 is a cross-sectional side view of the multidirectional node of FIG. 2.

FIG. 2 is an enlarged perspective side view of a multidirectional node connector 108 of the environment isolation structure 100 of FIG. 1. FIG. 3 is a cross-sectional side view of the multidirectional node connector 108 of FIG. 2. With combined reference to FIG. 2 and FIG. 3, each multidirectional node connector 108 of the environment isolation structure 100 may have an at least substantially polyhedron shape. For example, the multidirectional node connectors 108 shown in FIG. 2 and FIG. 3 may be shaped as rectangular prisms (e.g., cubes). More specifically, the multidirectional node connector 108 of FIG. 2 and FIG. 3 may take the form of cubes having rounded and/or chamfered edges and corners. When a frame 102 includes only multidirectional node connectors 108 shaped as rectangular prisms, and the poles 104 and/or fixed-length poles 106 at opposite sides of each respective polygon shape of each face of the frame 102 are of equal lengths, the frame 102 may be shaped as a rectangular prism (e.g., a cube). In other embodiments, the multidirectional node connector 108 may have other polyhedron shapes, such as, for example, tetrahedrons, square pyramids, octahedrons, dodecahedrons, icosahedrons, irregular polyhedrons, and other three-dimensional shapes that may be desired. The resulting frame may have a correspondingly different polyhedron shape, such as, for example, a square pyramid, a trapezoidal prism, a pentagonal prism, etc. In still other embodiments, the multidirectional node connector 108 may have a shape that is not strictly a polyhedron, such as, for example, a sphere. The resulting frame may have a polyhedron shape depending primarily on the number, position, and orientation of attachment locations 202 on the multidirectional node connectors 108.

Each multidirectional node connector 108 may include multiple attachment locations 202 configured to enable the poles 104 and/or fixed-length poles 106 to be temporarily secured to the respective multidirectional node connector 108. At least some of the attachment locations 202 may be located on different sides of the multidirectional node connectors 108, enabling the respective poles 104 and/or fixed-length poles 106 to extend from an attached multidirectional node connector 108 in different directions. For example, each multidirectional node connector 108 may include an at least substantially polyhedron shape, and each attachment location 202 of a given multidirectional node connector 108 may be located on a different face of the at least substantially polyhedron shape. More specifically, each multidirectional node connector 108 may have an at least substantially rectangular prism shape (e.g., cubic), and one of the attachment locations 202 may be located on each face (e.g., each major planar surface) of the at least substantially rectangular prism shape. In some embodiments, some sides of a given multidirectional node connector 108 may include multiple attachment locations 202 on the same side.

Connectors 206 may be a separate component affixed to longitudinal ends of the poles 104 and the fixed-length poles 106, or it may be an integral, unitary part of the poles 104 and/or fixed-length poles 106 located at the ends of the poles 104 and the fixed-length poles 106. Each connector 206 may be configured to selectively attach to a respective attachment location 202 on a given side of a respective multidirectional node connector 108. For example, at least one of the attachment locations 202 and at least two of the connectors 206 of the poles 104 and/or fixed-length poles 106 may be configured to attach to one another, such that the longitudinal ends of two poles 104 and/or fixed-length poles 106 may extend toward, and be selectively attachable to, the respective attachment location 202.

The connectors 206 of at least some of the poles 104 and/or fixed-length poles 106 may be configured to constrain movement of the associated poles 104 and/or fixed-length poles 106 in at least some directions to control freedom of movement, and associated adjustability, of the frame 102. For example, the connectors 206 of at least some of the poles 104 and/or fixed-length poles 106 may be configured to constrain movement of the associated poles 104 and/or fixed-length poles 106 relative to a connected multidirectional node connector 108 about all but one axis of rotation and all but one direction of linear translation. More specifically, the connectors 206 of at least some of the poles 104 and/or fixed-length poles 106 may be configured to limit movement of the associated poles 104 and/or fixed-length poles 106 to, for example, rotation about a longitudinal axis 302 of the respective pole 104 or fixed-length pole 106 and linear insertion into, and extraction from, the attachment location 202 of the multidirectional node connector 108 in a direction along the longitudinal axis 302 of the respective pole 104 or fixed-length pole 106.

As another example, the connectors 206 of at least some others of the poles 104 and/or fixed-length poles 106 may be configured to constrain movement of the associated poles 104 and/or fixed-length poles 106 relative to other connected multidirectional node connectors 108 about all but two or three axes of rotation and all but one direction of linear translation. More specifically, the connectors 206 of at least some of the poles 104 and/or fixed-length poles 106 may be configured to limit movement of the associated poles 104 and/or fixed-length poles 106 to, for example, rotation about a longitudinal axis 302 of the respective pole 104 or fixed-length pole 106. In some embodiments, the connectors 206 may be configured as male threaded bolts, which may partially limit movement of the poles 104 and/or fixed-length poles 106 to rotation about a longitudinal axis 302, as the relevant connector 206 is threaded into and out from a corresponding female threaded receptacle 306 of the multidirectional node connector 108.

As another more specific example, the connectors 206 of at least some of the poles 104 and/or fixed-length poles 106 may limit movement to rotation about an axis of rotation 304 aligned with a longitudinal axis of a selectively latchable pin 204 with which the connector 206 may be engaged. In some embodiments, the connectors 206 may be configured as eyelet joints or heim joints, which may limit or partially limit movement of the poles 104 and/or fixed-length poles 106 to rotate about a selectively latchable pin 204 inserted through the opening of the eyelet joint or heim joint, such that the angle at which the pole 104 and/or fixed-length pole 106 may be oriented with respect to a fixed reference plane (e.g., a vertical plane, a horizontal plane, an adjacent face of the frame 102, an adjacent pole 104 or fixed-length pole 106 that is securable to the multidirectional node connector 108 by a threaded connection) may be adjustable. When a connector 206 is configured as a heim joint, the associated pole 104 and/or fixed-length pole 106 may also be permitted to have some limited rotation about its own longitudinal axis 302, which may render assembly of the frame 102 easier by permitting some degree of freedom in the orientation of the pole 104 and/or fixed-length pole 106 that will permit insertion of the selectively latchable pin 204.

As yet another more specific example, the connectors 206 of at least some of the poles 104 and/or fixed-length poles 106 may at least partially limit movement to linear insertion into, and extraction from, the attachment location 202 of the multidirectional node connector 108 in a direction along the longitudinal axis 302 of the respective pole 104 or fixed-length pole 106. In some embodiments, the connectors 206 may be configured as male threaded bolts, which may partially limit movement of the poles 104 and/or fixed-length poles 106 to insertion and extraction along the longitudinal axis 302, as the relevant connector 206 is threaded into and out from a corresponding female threaded receptacle 306 of the multidirectional node connector 108. In other embodiments, the connectors 206 may be configured as eyelet joints or heim joints, which may partially limit movement of the poles 104 and/or fixed-length poles 106 to linear motion along a longitudinal axis of a selectively latchable pin 204 inserted through the opening of the eyelet joint or heim joint. In some such embodiments, the connector 206 may be interposed between, and may abut against, surfaces of the multidirectional node connector 108 and the selectively latchable pin 204, which may reduce the freedom of linear movement of the connector 206 along the longitudinal axis of the selectively latchable pin 204.

The multidirectional node connectors 108, poles 104 and/or fixed-length poles 106, and connectors 206 may be configured to constrain movement of at least one of the multidirectional node connectors 108 to be linear with respect to at least another of the multidirectional node connectors 108. For example, the multidirectional node connectors 108, poles 104 and/or fixed-length poles 106, and connectors 206 may be configured to constrain movement of a subset of the multidirectional node connectors 108 (e.g., each of the multidirectional node connectors 108 at the top four corners of the environment isolation structure 100 of FIG. 1, each of the multidirectional node connectors 108 at the bottom four corners of the environment isolation structure 100 of FIG. 1) to be linear with respect to a remainder of the multidirectional node connectors 108.

More specifically, and with additional reference to FIG. 1, when the lengths of all the poles 104 directly connected to the multidirectional node connectors 108 other than the multidirectional node connector 108 in the upper right corner of the frame 102 are fixed, and the lengths of the poles 104 directly connected to the multidirectional node connector 108 in the upper right corner of the frame 102 are free to increase and decrease, the multidirectional node connector 108 in the upper right corner of the frame 102 may be free to translate linearly in a vertical direction (e.g., up or down), and other movement of the multidirectional node connector 108 in the upper right corner of the frame 102 may be at least substantially constrained. The same kind of adjustment may be made for each multidirectional node connector 108 in the upper corners of the frame 102 shown in FIG. 1. Because the poles at the bottom of the frame 102 are fixed-length poles 106, the multidirectional node connectors 108 in the lower corners of the frame 102 of FIG. 1 may only be adjustable linearly relative to the multidirectional node connectors 108 at the upper corners of the frame 102 of FIG. 1 collectively and concurrently.

To facilitate, and beneficially constrain, such adjustability of the frame 102 (see FIG. 1), and returning more specifically to FIG. 2 and FIG. 3, a given multidirectional node connector 108 may include at least one threaded female receptacle 306 forming at least one of the attachment locations 202. For example, two of the attachment locations 202 on opposite sides of each multidirectional node connector 108 (e.g., those facing upward and downward when the frame 102 is oriented as shown in FIG. 2 and FIG. 3) may include threaded holes 308 forming threaded female receptacles 306 for receiving connectors 206 of the poles 104 configured as threaded male connectors 310.

In addition, a given multidirectional node connector 108 may include at least one snap female receptacle 312 forming at least another of the attachment locations 202. For example, a remainder of the attachment locations 202 (e.g., those facing toward horizontal, lateral sides of the multidirectional node connector 108 when the frame 102 is oriented as shown in FIG. 2 and FIG. 3) may include at least one snap female receptacle 312 for receiving those connectors 206 of the poles that may be configured as quick-release connectors. More specifically, those attachment locations 202 configured as snap female receptacles 312 may include a hole 308 having a dual-diameter shape forming a ledge 314 sized, shaped, and positioned to receive a selectively latchable pin 204 therein.

The frame 102 may include selectively latchable pins 204 configured to attach at least some of the connectors 206 of the poles 104 and/or the fixed-length poles 106 to respective ones of the multidirectional node connectors 108. For example, the selectively latchable pins 204 may include a detent pin 318 and spring-loaded locking bodies or tabs 316 (e.g., spring-loaded balls) located within a housing 320 of a given selectively latchable pin 204. In some embodiments, the detent pin 318 may have a dual-diameter shape that forces the tabs 316 to an extended position to engage with the ledge 314 when the detent pin 318 is in a first position (e.g., an extended position, a retracted position), retaining the selectively latchable pin 204 in the associated snap female receptacle 312 of the multidirectional node connector 108. The dual-diameter shape of the detent pin 318 may also enable the tabs 316 to move to a retracted position to disengage from the ledge 314 when the detent pin 318 is in a second position (e.g., a depressed position, a pulled-out position), freeing the selectively latchable pin 204 for removal from, or insertion into, the relevant snap female receptacle 312 of the multidirectional node connector 108. In other embodiments, the tabs 316 may be retainable in each of an extended position and a retracted position by the housing 320, and may be free to move between the extended position and the retracted position when the detent pin 318 is in a fully pulled-out position, enabling the selectively latchable pin to be inserted into and removed from the associated snap female receptacle 312. When the detent pin 318 is in a retracted position, as shown in FIG. 3, the detent pin 318 may force the locking tabs 316 outward to the extended position, causing the tabs 316 to engage with the ledge 314, inhibiting removal of the selectively latchable pin 204 from the associated snap female receptacle 312. The detent pin 318 may be biased toward a selected position (e.g., utilizing a spring, a compressible gas, a resilient polymer material), such as the position that causes the tabs 316 to be forced outward to engage with the ledge 314. In such a configuration, the selectively latchable pin 204 may be characterized as a "spring-loaded, quick-release detent pin."

At least one of the connectors 206 at a given longitudinal end of a pole 104 or a fixed-length pole 106 may include an at least partially enclosed opening through which the selectively latchable pin 204 may extend. For example, connectors 206 at longitudinal ends of at least some of the poles 104 and/or fixed-length poles 106 may include eyelet joint or heim joint 322 configured to selectively attach to a respective attachment location 202 on a given side of a respective multidirectional node connector 108 utilizing a selectively latchable pin 204. Utilizing heim joints 322 may increase ease of assembly and adjustment of the positions of the multidirectional node connectors 108, and associated shape of the frame 102, as the additional, limited degree of rotational freedom provided by heim joints 322 may make aligning the selectively latchable pin 204, and moving the components attached to one another via the heim joints 322, easier (e.g., by reducing friction and mechanical interference). Others of the connectors 206 may include threaded male connectors 310 for threaded engagement with the threaded female receptacles 306 of the multidirectional node connectors 108. The connectors 206 may be assembled with the poles 104 and or fixed-length poles 106 utilizing pole end caps 324 to which the connectors 206 may be affixed.

The frame 102 may further include at least one bumper 208 configured to selectively attach to a respective attachment location 202 on a given side of a respective multidirectional node connector 108. For example, the bumper 208 may include a mass of material configured to reduce the likelihood that the frame 102 may unintentionally slide relative to an intended deployment position and that the frame 102 may scratch or otherwise damage a repair area against which the frame 102 may abut. More specifically, the bumper 208 may include a mass of resilient, polymer material (e.g., rubber). The bumper 208 may also include a connector 206 (e.g., a threaded male connector 310 or a selectively latchable pin 204) to enable the bumper 208 to be selectively and removably secured to a given attachment location 202 of a multidirectional node connector 108.

Figure 4:
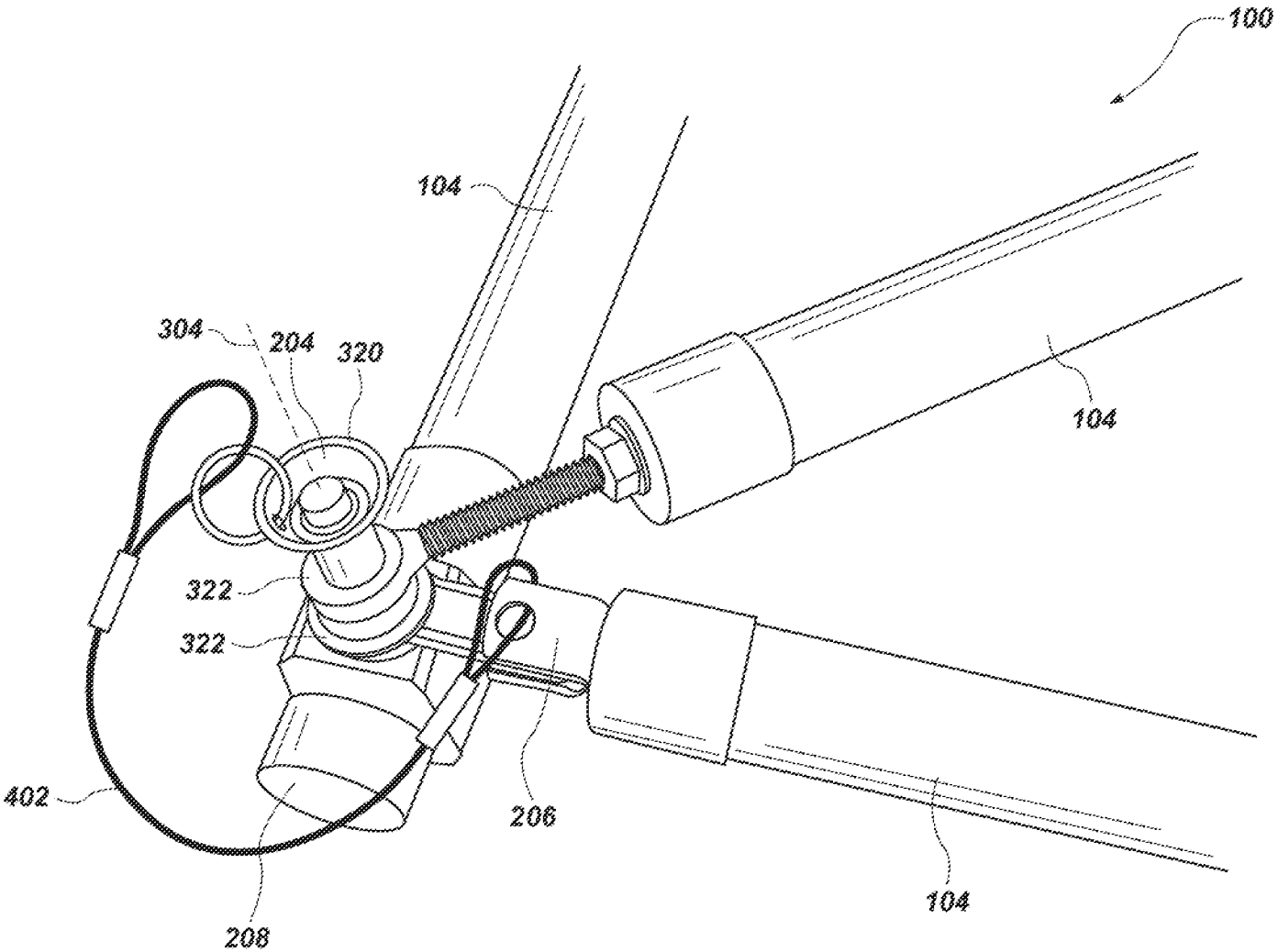
FIG. 4 is a perspective side view of another embodiment of a multidirectional node illustrating a tether configured to form a secondary, backup attachment between components of the environment isolation structure.

FIG. 4 is a perspective side view of an embodiment of a multidirectional node connector 108 illustrating a tether 402 configured to form a secondary, backup attachment between components of the environment isolation structure 100. In some embodiments, certain small components of the environment isolation structure 100 may be secured to larger components of the environment isolation structure 100 to reduce the risk of losing the small components and of the small components becoming potentially dangerous loose objects (e.g., when subjected to the conditions present in an active airfield). For example, a tether 402 having sufficiently high strength and resilience (e.g., a braided wire cable, a paracord) may secure the housing 320 of each selectively latchable pin 204 to a portion of the associated connector 206 at the longitudinal end of the relevant pole 104 or fixed-length pole 106.

Figure 5:
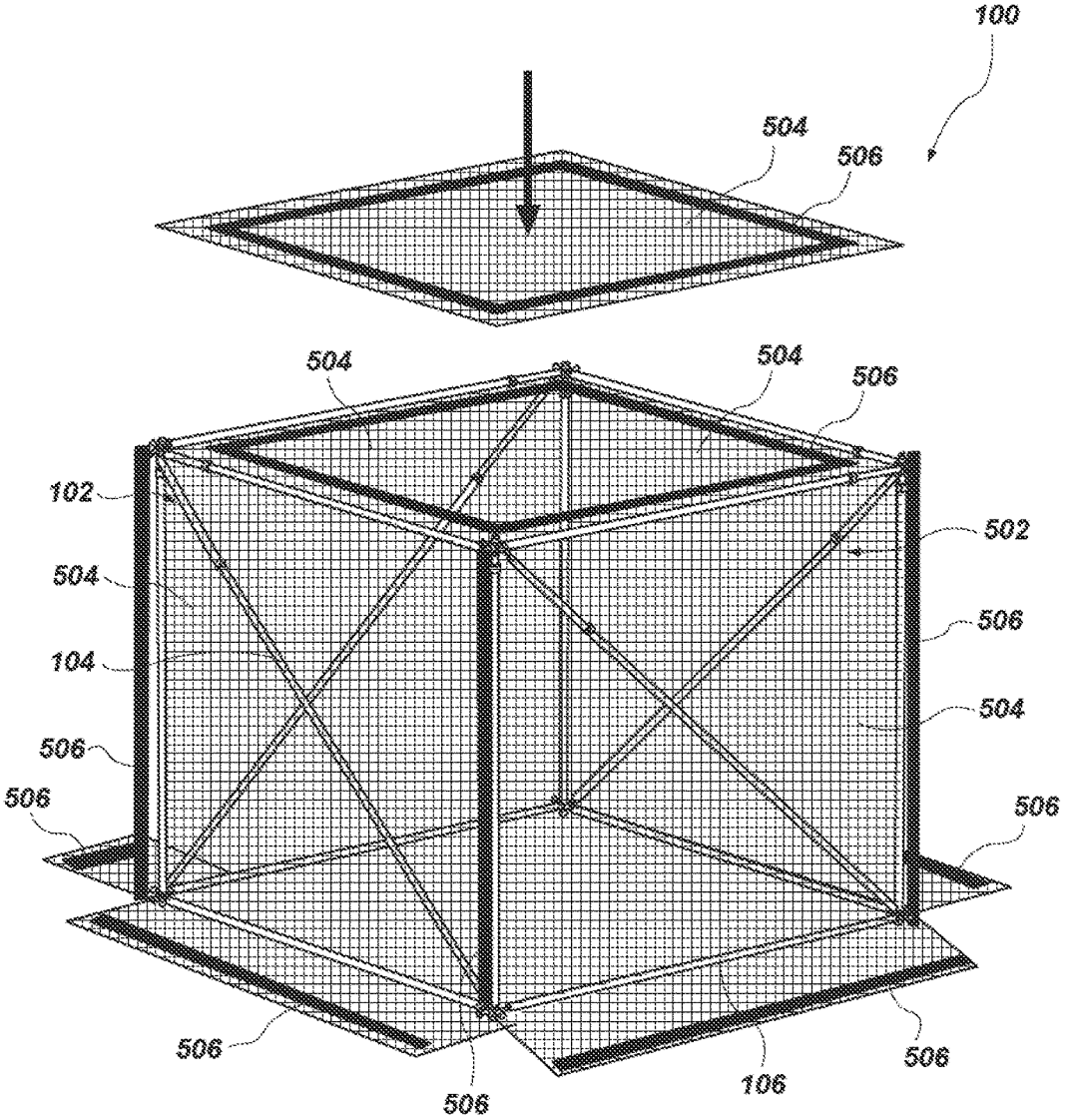
FIG. 5 is a perspective side view of the environment isolation structure of FIG. 1 illustrating a cover of the environment isolation structure.

FIG. 5 is a perspective side view of the environment isolation structure 100 of FIG. 1 illustrating a cover 502 of the environment isolation structure 100. The cover 502 may be supportable on, and may be positionable over portions of, the frame 102. The cover 502 may be configured to reduce the likelihood that environmental contaminants may pass from outside the environment isolation structure 100, through the cover 502, to the interior of the environment isolation structure 100.

The cover 502 may include flexible panels 504 which may be securable to the frame 102 and which may be interconnectable to one another to form a barrier. The flexible panels 504 may be formed of sheets of a resilient, strong material, such as, for example, a polymer material. The flexible panels 504 may be translucent or transparent to enable an observer outside the environment isolation structure 100 to at least partially view the contents of the environment isolation structure 100.

The flexible panels 504 may be sized and shaped to generally conform to a polygon shape of a given face of the frame 102 when the poles 104 having adjustable lengths are at maximum length. For example, the flexible panels 504 shown in FIG. 5 may be generally rectangular in shape, and may include additional portions of flexible material to form connections with adjacent flexible panels 504, supporting surfaces, and/or surfaces proximate to repair areas to be isolated utilizing the environment isolation structure 100. In other embodiments, the flexible panels 504 may have other general shapes. A given flexible panel 504 may be securable to the frame 102 to provide a barrier (e.g., to inhibit fluid flow between the interior and the exterior of the environment isolation structure 100), or removable from the frame 102 (or omitted during assembly) to provide access through a selected face of the environment isolation structure 100.

Each of the flexible panels 504 may include a material or structure proximate to at least one distal end of the flexible panel 504 to enable the flexible panel 504 to be connected to an adjacent flexible panel 504, supporting surfaces, and/or surfaces proximate to repair areas to be isolated utilizing the environment isolation structure 100. For example, each of the flexible panels 504 may include at least one hook-and-loop connector 506 extending proximate to an edge of the flexible panel 504. More specifically, the flexible panels 504 may include strips of hook-and-loop connectors 506 extending along some sides of the flexible panels 504 to enable the flexible panels 504 to be connected to one another proximate to, and over, the poles 104, on other sides of the flexible panels 504 to enable the flexible panels 504 to be connected to a surface of a workpiece around an area to be isolated proximate to the top of the environment isolation structure 100 when in the orientation shown in FIG. 5 and when the top flexible panel 504 is removed, and on still other sides to enable the flexible panels 504 to be connected to a surface on which the environment isolation structure 100 may be supported (e.g., the ground) proximate to the bottom of the environment isolation structure 100 when in the orientation shown in FIG. 5.

In some embodiments, a given flexible panel 504 may include one or more ports to enable an accessory to be deployed in connection with the environment isolation structure 100. For example, the ports may enable a gloved accessory to be supported by the flexible panel 504, enabling a user to manipulate objects within the interior of the environment isolation structure 100 from the exterior of the environment isolation structure 100 without significant exposure to environmental conditions within the environment isolation structure 100. As another example, the ports may enable a fluid having a controlled composition (e.g., air, air within a selected temperature range) to be pumped into, and optionally out of, the interior of the environment isolation structure 100. Providing a fluid input may be sufficient in at least some scenarios because positive pressure within the environment isolation structure 100 may keep the environment isolation structure 100 at least substantially free of environmental contaminants from the exterior of the environment isolation structure 100.

Figure 6:
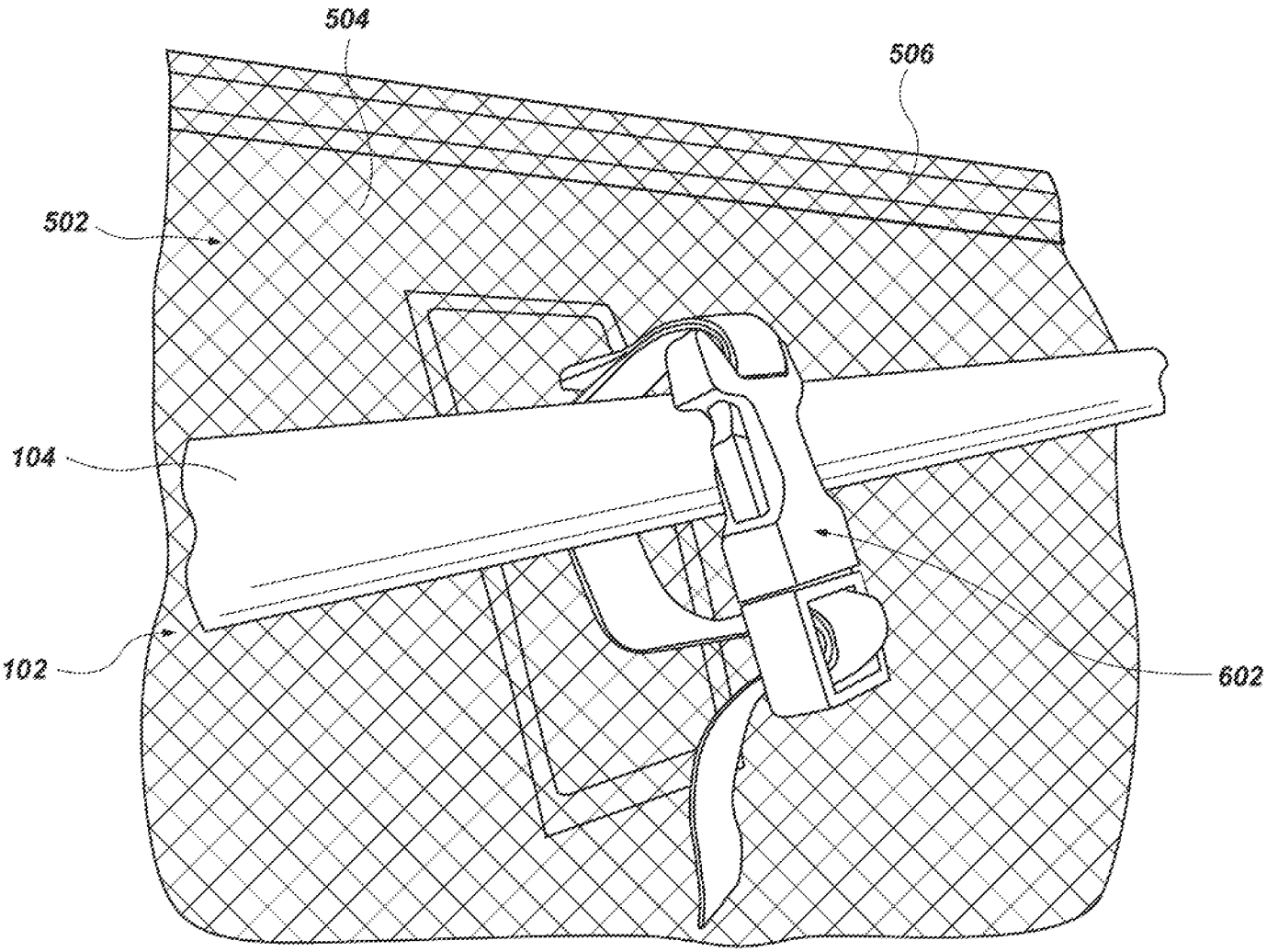
FIG. 6 is an enlarged perspective side view of the cover of FIG. 5, showing one illustrative embodiment of an attachment member for securing the cover to a frame of the environment isolation structure.

FIG. 6 is an enlarged perspective side view of the cover of FIG. 5, showing one illustrative embodiment of an attachment member 602 for securing the cover to a frame of the environment isolation structure 100. The attachment members 602 may be distributed at least substantially in lines proximate to the edges of a flexible panel 504, and optionally along diagonals of the polygon shape of a given face of the frame 102, to enable the flexible panel 504 to be secured to, and removed from, the poles 104 and/or fixed-length poles 106 of the frame 102. The attachment members 602 may be configured as, for example, C-clamps, carabiners, straps with buckle clips, ties, or other structures for securing a flexible panel 504 to a tubular pole 104 and/or fixed-length pole 106. More specifically, the attachment members 602 may include a fabric belt sewn to the material of the flexible panel 504 and buckle clips to secure the belt around a given pole 104 and/or fixed-length pole 106, with the length of the belt being adjustable to adjust a fit of the attachment member 602 around the pole 104 and/or fixed-length pole 106.

Figure 7:
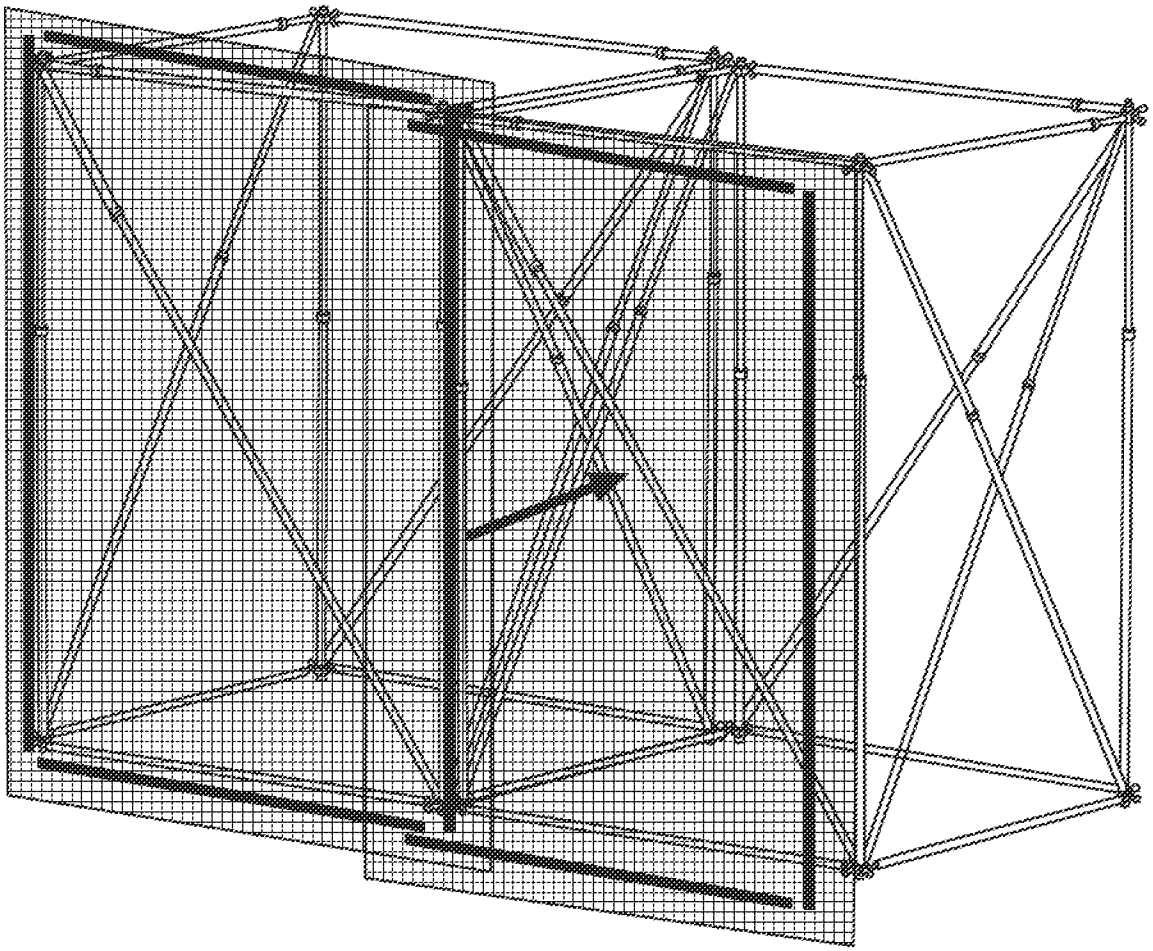
FIG. 7 is a perspective side view of an assembly of multiple environment isolation structures.

FIG. 7 is a perspective side view of an assembly of multiple environment isolation structures 100. The environment isolation structures 100 may be positionable proximate to one another, and the covers 502 may be selectively deployed, to enable the environment isolation structures 100 to collectively enclose a larger area to be isolated. For example, the frames 102 of the environment isolation structures 100 may be located adjacent to one another, the flexible panels 504 that would cover the planes where the environment isolation structures 100 abut against one another may be removed or omitted, and the remaining flexible panels 504 may be installed to at least partially enclose the interiors of the frames 102. More specifically, the attachment locations 202 of adjacent multidirectional node connectors 108 may be secured to one another (e.g., utilizing two-sided threaded male connectors 310 or selectively latchable pins 204), and the cover 502 may be configured to at least partially enclose the space within the collective frames 102.

Figure 8:
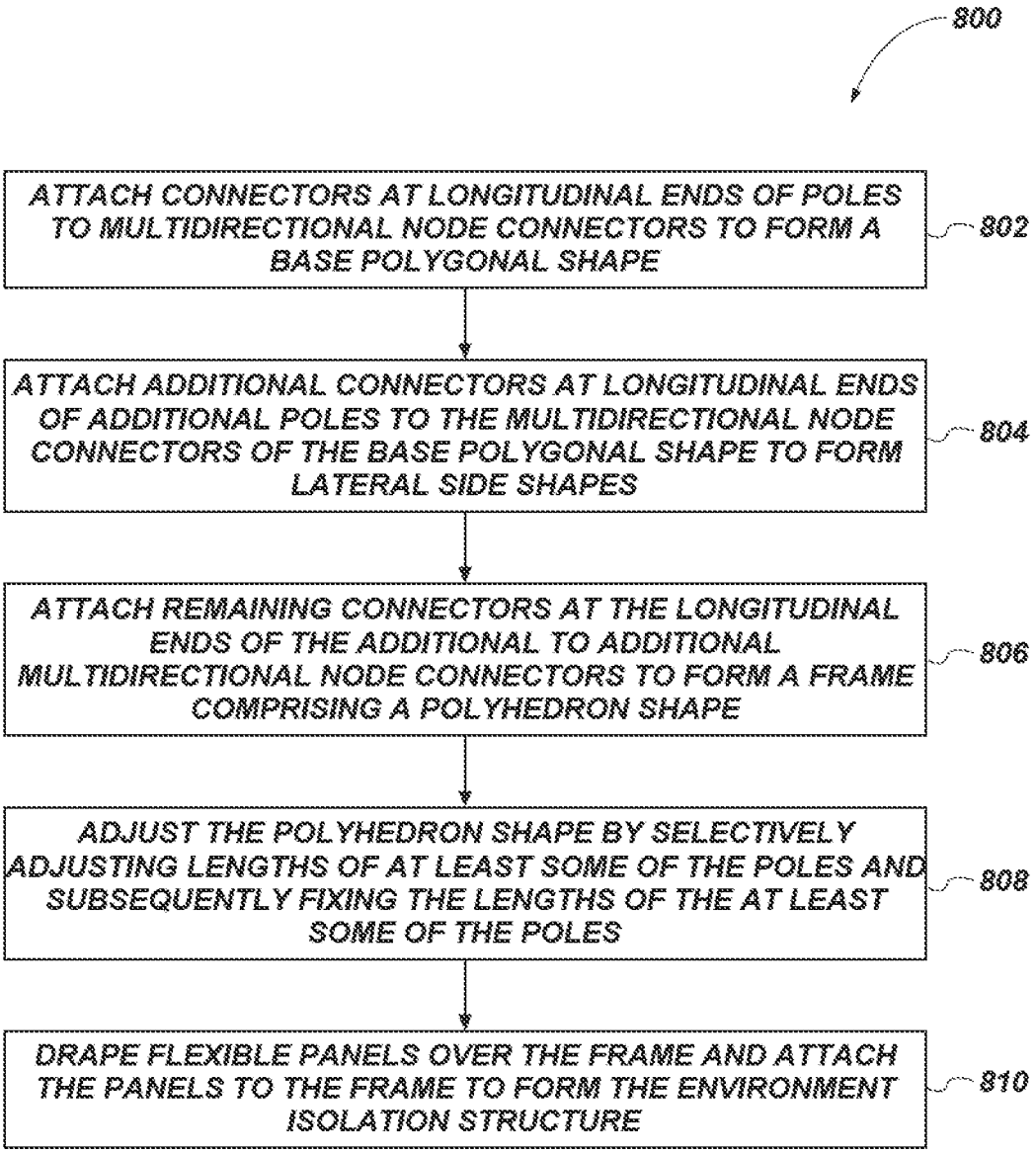
FIG. 8 is a flowchart of a method of assembling an environment isolation structure in accordance with this disclosure.

FIG. 8 is a flowchart of a method 800 of assembling an environment isolation structure in accordance with this disclosure. The method may involve attaching connectors 206 (see FIG. 2) at longitudinal ends of poles 104 (see FIG. 1) and/or fixed-length poles 106 (see FIG. 1) to multidirectional node connectors 108 (see FIG. 1) to form a base polygonal shape, as indicated at act 802. For example, the heim joints 322 (see FIG. 3) or eyelet joints at the longitudinal ends of the fixed-length poles 106 (see FIG. 1) may be connected to the multidirectional node connectors 108 (see FIG. 1) at the four corners of the right rectangle shape (e.g., the square) at the bottom of the environment isolation structure 100 (see FIG. 1) utilizing selectively latchable pins 204 (see FIG. 2), when the environment isolation structure 100 is to be deployed in the orientation shown in FIG. 1.

Additional connectors 206 (see FIG. 2) at longitudinal ends of additional poles 104 (see FIG. 1) and/or fixed-length pole 106 may be connected to the multidirectional node connectors 108 (see FIG. 1) of the base polygonal shape to form lateral side shapes (e.g., faces), as shown at act 804. For example, the threaded male connectors 310 (see FIG. 3) at the longitudinal ends of some poles 104 (see FIG. 1) may be threaded into corresponding threaded female receptacles 306 (see FIG. 3) of the multidirectional node connectors 108 (see FIG. 1), and the heim joints 322 (see FIG. 3) at the longitudinal ends of other poles 104 (see FIG. 1) may be secured to snap female receptacles 312 (see FIG. 3) of the multidirectional node connectors 108 utilizing selectively latchable pins 204 (see FIG. 2) to form right rectangle shapes when the poles 104 (see FIG. 1) are in a fully retracted state.

Any remaining connectors 206 (see FIG. 2) at the longitudinal ends of the additional poles 104 (see FIG. 1) may be attached to additional multidirectional node connectors 108 (see FIG. 1) to form a frame 102 (see FIG. 1) comprising a polyhedron shape, as indicated at act 806. For example, the adjacent right rectangle shapes at the lateral faces of the frame 102 (see FIG. 1), when oriented as shown in FIG. 1, may be interconnected to one another, and the diagonal poles 104 (see FIG. 1) may be installed, by inserting selectively latchable pins 204 (see FIG. 2) through the heim joints 322 (see FIG. 3) or eyelet joints at the longitudinal ends of the remaining poles 104 (see FIG. 1). In some embodiments, the diagonal poles 104 (see FIG. 1) may form a cross-bar bisecting the polygon shape at the lateral face of the frame 102 (see FIG. 1), particularly when each of the poles 104 (see FIG. 1) is at the same length (e.g., in a fully contracted or fully extended state).

The polyhedron shape may be adjusted by selectively adjusting lengths of at least some of the poles 104 (see FIG. 1), and the lengths of the relevant poles 104 (see FIG. 1) may be fixed, as shown at act 808. For example, the clamps 114 (see FIG. 1) of each pole 104 extending from a given multidirectional node connector 108 (see FIG. 1) may be loosened, the bumper 208 (see FIG. 2) on the multidirectional node connector 108 (see FIG. 1) may be brought into contact with the workpiece proximate to a repair area, and the clamps 114 (see FIG. 1) may be retightened to fix the lengths of the poles 104 (see FIG. 1) and secure the multidirectional node connector 108 (see FIG. 1) in place.

Flexible panels 504 (see FIG. 5) may be draped over the frame 102 (see FIG. 1), and the flexible panels 504 (see FIG. 5) may be secured to the frame 102 (see FIG. 1) to form the environment isolation structure 100 (see FIG. 1), as shown at act 810. For example, the flexible panels 504 (see FIG. 5) may be placed over relevant polygon shapes forming respective faces of the frame 102 (see FIG. 1), at least some of the attachment members 602 (see FIG. 6) of the flexible panels 504 (see FIG. 5) may be secured around associated portions of the poles 104 (see FIG. 1) and/or fixed-length poles 106 (see FIG. 1). For example, all of the attachment members 602 may be secured to corresponding poles 104 and/or fixed-length poles 106 when the poles 104 and/or fixed-length poles 106 are oriented at least substantially vertically and horizontally. When some of the poles 104 and/or fixed-length poles 106 are oriented at oblique angles relative to vertical and horizontal, only some of the attachment members 602 (e.g., those at highest elevations) may be secured to the poles 104 and/or fixed-length poles 106, and a remainder of the flexible panel 504 may drape freely over the frame 102 under the force of gravity, potentially with other points of connection between the flexible panel 504 and the frame 102 or a work surface (e.g., hook-and-loop connectors 506, adhesive tape). The hook-and-loop connectors 506 (see FIG. 5) of the flexible panels 504 (see FIG. 5) may be contacted to one another to interconnect the flexible panels 504 (see FIG. 5) and form portions of the cover 502 (see FIG. 5).

In addition, the hook-and-loop connectors 506 (see FIG. 5) of at least certain flexible panels 504 (see FIG. 5) may be secured to corresponding hook-and-loop connectors 506 (see FIG. 5) deployed around the area to be isolated or on the surface supporting the environment isolation structure 100 (see FIG. 1) to better isolate the space within the environment isolation structure 100 (see FIG. 1). For example, one flexible panel 504 (see FIG. 5), such as the flexible panel 504 (see FIG. 5) positioned at the top of the environment isolation structure 100 (see FIG. 1) in the orientation shown in FIG. 5, may only be securable to a remainder of the environment isolation structure 100 (see FIG. 1) by hook-and-loop connectors 506 (see FIG. 5). That flexible panel 504 (see FIG. 5) may be removed, and the remaining flexible panels 504 (see FIG. 5) may be secured to a corresponding strip of hook-and-loop connectors deployed around the work surface. As another example, that flexible panel 504 (see FIG. 5) may be removed, and the remaining flexible panels 504 (see FIG. 5) may be temporarily secured around a work site using adhesive tape.

Environment isolation structures 100 (see FIG. 1) in accordance with this disclosure may weigh about 35 lbs or less (e.g., between about 25 lbs and about 35 lbs). In addition, environment isolation structures 100 (see FIG. 1) in accordance with this disclosure may be configured to be assembled by 3 or fewer people (e.g., between 1 and 3 people) in about 5 minutes or less (e.g., between about 4 minutes and about 5 minutes).

In comparison to existing structures known to the inventors for isolating workspaces for aircraft, environment isolation structures in accordance with this disclosure may be more easily transported to the work site, assembled, adjusted in shape and positioning, configured to at least substantially isolate a workspace, disassembled, transported for storage, and reused. Such environment isolation structures may be of particular utility for isolating repair areas on aircraft, where sloping, curved, and irregular surfaces may require contact, and specialized composite materials may require specific environmental conditions to effect repairs. Furthermore, environment isolation structures in accordance with this disclosure may reduce the risk of losing components of the environment isolation structures, such that the risk of any component becoming a dangerous projectile when exposed to airfield conditions may be mitigated.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure.

What is claimed is:

1. A kit for assembling an environment isolation structure, comprising:

a reconfigurable frame, comprising:

multidirectional node connectors comprising multiple attachment locations, at least some of the attachment locations located on different sides of the multidirectional node connectors;

poles configured to telescope to selectively fixable lengths; and connectors affixed to longitudinal ends of the poles, each connector configured to selectively attach to a respective attachment location on a given side of a respective multidirectional node connector; and flexible panels configured to at least partially cover, and be attached to, the frame;

wherein the connectors of at least some of the poles are configured to constrain movement relative to a connected multidirectional node connector about all but one axis of rotation and ail but one direction of linear translation, and wherein the connectors of at least some others of the poles are configured to constrain movement relative to another connected multidirectional node connector about all but two or three axes of rotation and ail but one direction of linear translation.

2. The kit of claim 1, wherein the multidirectional node connector, poles, and connectors are configured to constrain movement of at least one of the multidirectional node connectors to be linear with respect to at least another of the multidirectional node connectors.

3. The kit of claim 2, wherein the multidirectional node connector, poles, and connectors are configured to constrain movement of a subset of the multidirectional node connectors to be linear with respect to a remainder of the multidirectional node connectors.

4. The kit of claim 1, wherein each multidirectional node connector comprises an at least substantially polyhedron shape and wherein each attachment location is located on a respective side of the at least substantially polyhedron shape.

5. The kit of claim 4, wherein each multidirectional node connector comprises an at least substantially cubic shape comprising one of the attachment locations on each side of the at least substantially cubic shape.

6. The kit of claim 1, wherein each of the multidirectional node connectors comprises:

at least one threaded female receptacle forming at least one of the attachment locations; and at least one snap female receptacle forming at least another of the attachment locations, the at least one snap female receptacle comprising a hole comprising a dual-diameter shape forming a ledge sized, shaped, and positioned to receive a selectively latchable pin therein.

7. The kit of claim 1, wherein at least one of the attachment locations and at least two of the connectors are configured to attach to one another, such that the longitudinal ends of two poles extend toward, and are selectively attachable to, the at least one of the attachment locations.

8. The kit of claim 1, wherein at least one of the connectors comprises an eyelet joint or heim joint configured to selectively attach to a respective attachment location on a given side of a respective multidirectional node connector utilizing a selectively latchable pin.

9. The kit of claim 1, wherein the flexible panels are translucent or transparent.

10. The kit of claim 1, wherein at least one of the flexible panels is securable to a remainder of the environment isolation structure by a hook-and-loop connection with others of the flexible panels.

11. The kit of claim 1, further comprising selectively latchable pins configured to attach at least some of the connectors of the poles to respective ones of the multidirectional node connectors.

12. The kit of claim 11, wherein the selectively latchable pins comprise spring-loaded, quick-release detent pins.

13. The kit of claim 12, wherein each of the selectively latchable pins comprises a tether configured to form a secondary, backup attachment between each of the selectively latchable pins and a remainder of the environment isolation structure.

14. The kit of claim 1, further comprising at least one fixed-length pole comprising additional connectors affixed to longitudinal ends of at least one fixed-length pole.

15. The kit of claim 1, further comprising at least one bumper configured to selectively attach to a respective attachment location on a given side of a respective multidirectional node connector.

16. The kit of claim 1, wherein the attachment locations enable the environment isolation structure to be attached to another, adjacent environment isolation structure as a module.

17. An environment isolation structure, comprising:

a reconfigurable frame, comprising:

multidirectional node connectors comprising multiple attachment locations, at least some of the attachment locations located on different sides of the multidirectional node connectors;

poles configured to telescope to selectively fixable lengths; and connectors affixed to longitudinal ends of the poles, each connector attached to a respective attachment location on a given side of a respective multidirectional node connector; and flexible panels at least partially covering, and attached to, the frame;

wherein the connectors of at least some of the poles are configured to constrain movement relative to a connected multidirectional node connector about all but one axis of rotation and all but one direction of linear translation, and wherein the connectors of at least some others of the poles are configured to constrain movement relative to another connected multidirectional node connector about all but two or three axes of rotation and all but one direction of linear translation.

18. The environment isolation structure of claim 17, wherein the multidirectional node connectors, poles, and connectors are configured to constrain movement of a subset of the multidirectional node connectors to be linear with respect to a remainder of the multidirectional node connectors.

19. The environment isolation structure of claim 17, wherein each of the multidirectional node connectors comprises:

at least one threaded female receptacle forming at least one of the attachment locations; and at least one snap female receptacle forming at least another of the attachment locations, the at least one snap female receptacle comprising a hole comprising a dual-diameter shape forming a ledge in which a portion of a selectively latchable pin attaching another of the connectors of the poles to the at least another of the attachment locations is received.

20. A method of assembling a reconfigurable environment isolation structure, comprising:

attaching connectors at longitudinal ends of poles to multidirectional node connectors to form a base polygonal shape;

attaching additional connectors at longitudinal ends of additional poles to the multidirectional node connectors of the base polygonal shape to form lateral side shapes;

attaching remaining connectors at the longitudinal ends of the additional poles to additional multidirectional node connectors to form a frame comprising a polyhedron shape;

adjusting the polyhedron shape by selectively adjusting lengths of at least some of the poles and subsequently fixing the lengths of the at least some of the poles;

draping flexible panels over the frame and attaching the panels to the frame to form the environment isolation structure;

constraining movement of at least some of the poles relative to a connected multidirectional node connector about all but one axis of rotation and all but one direction of linear translation utilizing the connectors of the at least some of the poles; and constraining movement of at least some others of the poles relative to another connected multidirectional node connector about all but two or three axes of rotation and all but one direction of linear translation utilizing the connectors of the at least some others of the poles.

21. The method of claim 20, further comprising attaching other connectors at longitudinal ends of other poles to a respective multidirectional node connector and a respective additional multidirectional node connector of each lateral side shape to form a cross-bar bisecting each respective lateral side shape.

22. The method of claim 20, wherein adjusting the polyhedron shape comprises bringing some of the multidirectional node connectors proximate to a surface of an object to be repaired, with an area of the surface for repair surrounded by poles extending between the some of the multidirectional node connectors.

* * * * *